US006598237B2

(12) United States Patent
Held

(10) Patent No.: US 6,598,237 B2
(45) Date of Patent: Jul. 29, 2003

(54) SELECTIVELY REMOVABLE DEVICE TO PROMOTE CIRCULATION OF AIR INTO AND OUT OF A HAT

(76) Inventor: William T. Held, 191 Buffalo Creek Rd., Elma, NY (US) 14059

( * ) Notice: Subject to any disclaimer, the term of this patent is extended or adjusted under 35 U.S.C. 154(b) by 0 days.

(21) Appl. No.: 10/123,678

(22) Filed: Apr. 16, 2002

(65) Prior Publication Data

US 2002/0162159 A1 Nov. 7, 2002

Related U.S. Application Data

(63) Continuation-in-part of application No. 09/519,107, filed on Mar. 6, 2000, now Pat. No. 6,370,697.

(60) Provisional application No. 60/175,944, filed on Jan. 13, 2000.

(51) Int. Cl.[7] ..... A42C 5/04

(52) U.S. Cl. ..... 2/184.5

(58) Field of Search ..... 2/184.5, 171.3, 2/171.4, 209.12, 175.12, 175.6

(56) References Cited

U.S. PATENT DOCUMENTS

| | | | |
|---|---|---|---|
| 1,955,986 | A | 4/1934 | Tice, Jr. |
| 2,398,363 | A | 4/1946 | Donson |
| 3,897,597 | A | 8/1975 | Kasper |
| RE29,452 | E | 10/1977 | Townsend, Jr. |
| 4,274,157 | A | 6/1981 | Boden |
| 4,390,998 | A | 7/1983 | Gallin |
| 4,476,589 | A | 10/1984 | Burgin et al. |
| 4,519,099 | A | 5/1985 | Kamiya et al. |
| 4,539,715 | A | 9/1985 | Clement |
| 4,964,178 | A | 10/1990 | Giancarlo et al. |
| 5,313,668 | A | 5/1994 | Bogan et al. |
| 5,365,607 | A | 11/1994 | Benevento, Jr. et al. |
| 5,481,760 | A | 1/1996 | Wood, Jr. |
| 5,487,191 | A | 1/1996 | Ridley |
| 5,592,936 | A | 1/1997 | Thomas, Jr. et al. |
| 5,625,901 | A | 5/1997 | Healy |
| 5,787,507 | A | 8/1998 | Sullivan |
| 5,867,840 | A | 2/1999 | Hirosawa et al. |
| 5,920,910 | A | 7/1999 | Calvo |
| 6,199,214 | B1 | 3/2001 | Campbell |

FOREIGN PATENT DOCUMENTS

| | | |
|---|---|---|
| GB | 2341784 A | 3/2000 |
| WO | WO01/50899 | 7/2001 |

*Primary Examiner*—Bibhu Mohanty
(74) *Attorney, Agent, or Firm*—Hodgson Russ LLP

(57) ABSTRACT

A device for allowing air to circulate is disclosed. An embodiment of the device has a base having an arcuate first side and a second side. The second side has a rib extending from the second side. The device also has a surface adapted for attaching the base to a hat.

11 Claims, 8 Drawing Sheets

SELECTIVELY REMOVABLE DEVICE TO PROMOTE CIRCULATION OF AIR INTO AND OUT OF A HAT

CROSS CLAIM TO RELATED APPLICATION

This is a continuation-in-part of U.S. patent application Ser. No. 09/519,107, filed Mar. 6, 2000. U.S. patent application Ser. No. 09/519,107 claims the benefit of U.S. provisional application No. 60/175,944 filed on Jan. 13, 2000. This application claims all benefits afforded by application Ser. No. 09/519,107 now U.S. Pat. No. 6,370,697 and No. 60/175,944.

BACKGROUND OF THE INVENTION

1. Field of the Invention

The invention relates generally to devices and methods of allowing air to circulate into and out of a hat.

2. Discussion of Related Art

In the prior art, there are devices that promote the circulation of air into and out of a hat in order to keep the wearer's head cool. One such device includes a flexible open mesh sewn into the hat. Such prior art devices have disadvantages. For example, such devices allow the sun to reach the wearer's head, thereby exposing the wearer to harmful radiation.

SUMMARY OF THE INVENTION

Accordingly, it is an object of the invention to provide a device and method of allowing air to circulate into and out of a hat.

The foregoing objective is realized by the invention, which includes a device for allowing air to circulate into and out of a hat. The device has a base having an arcuate first side and a second side. The second side has a rib extending from the second side. The device also has a means for attaching the base to a hat.

In a method according to the invention, a device having a base with an arcuate first side, a second side, and an attaching surface with a primary fastener attached thereto is provided. A hat having a complementary fastener attached thereto is provided. The device is attached to the hat by engaging the primary fastener with the complementary fastener.

Other objects and advantages of the invention will become apparent to those skilled in the art from the following detailed description read in conjunction with the attached drawings and claims appended hereto.

BRIEF DESCRIPTION OF THE DRAWINGS

For a fuller understanding of the nature and objects of the invention, reference should be made to the following detailed description taken in conjunction with the accompanying drawings, in which.

DETAILED DESCRIPTION OF THE INVENTION

Figure 2:
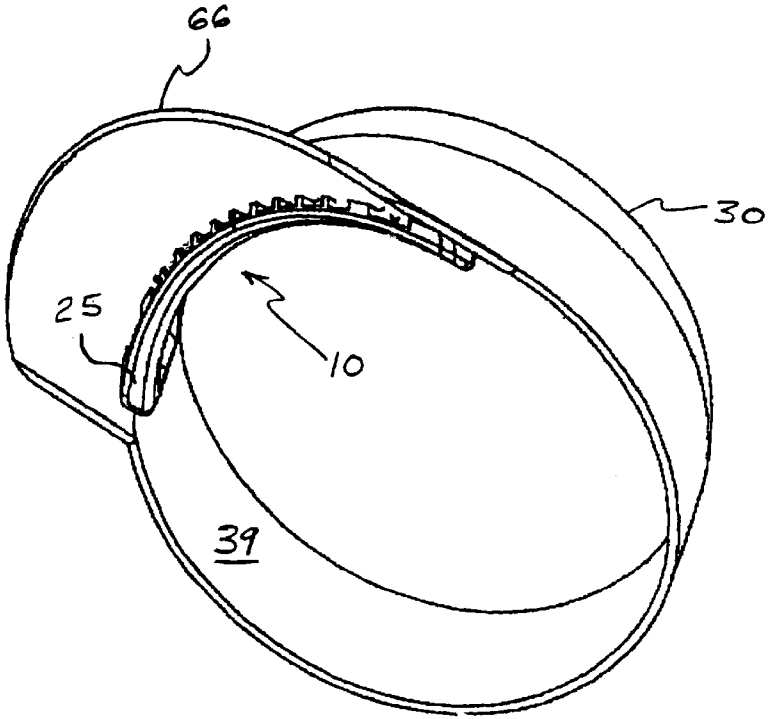
FIGS. 1 and 2 are perspective views of a hat having a device according to the invention attached thereto.
Figure 1:
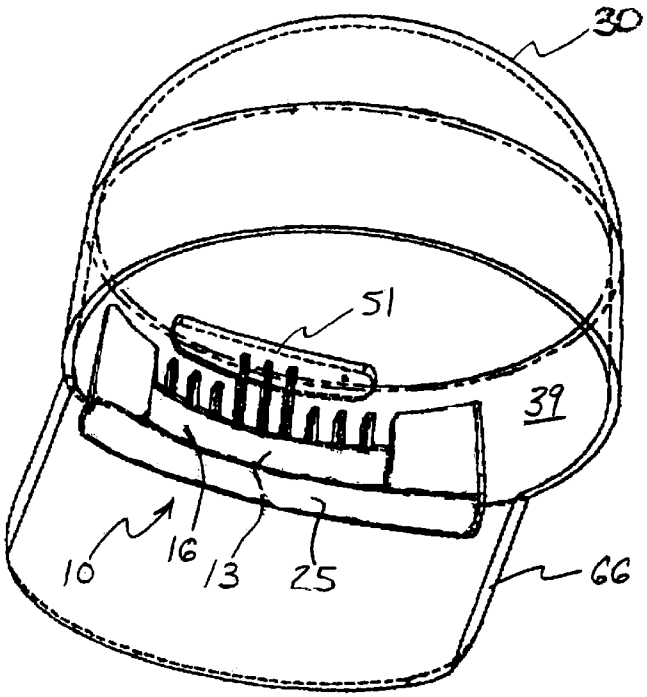
Figure 3:
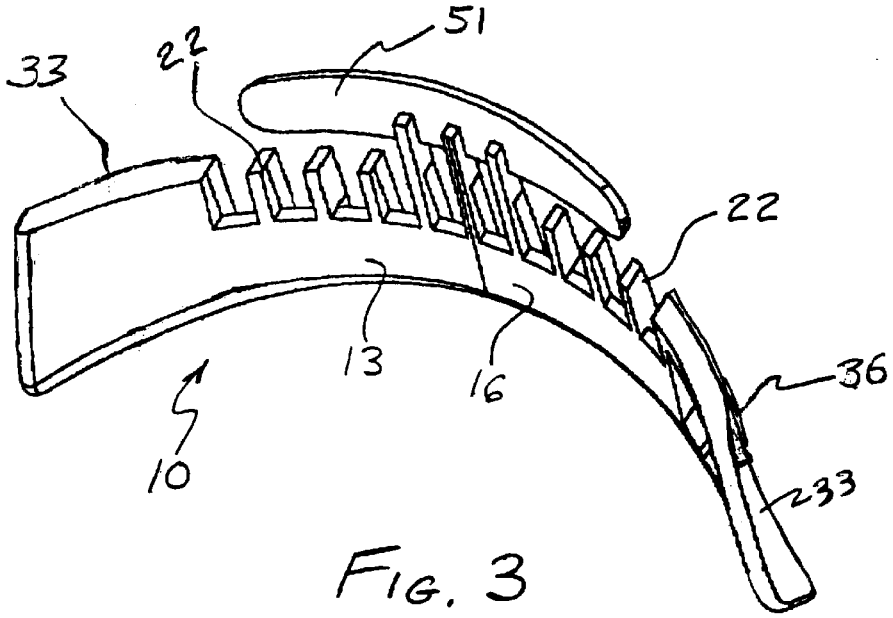
FIGS. 3 and 4 are perspective views of the device shown in FIGS. 1 and 2.
Figure 4:
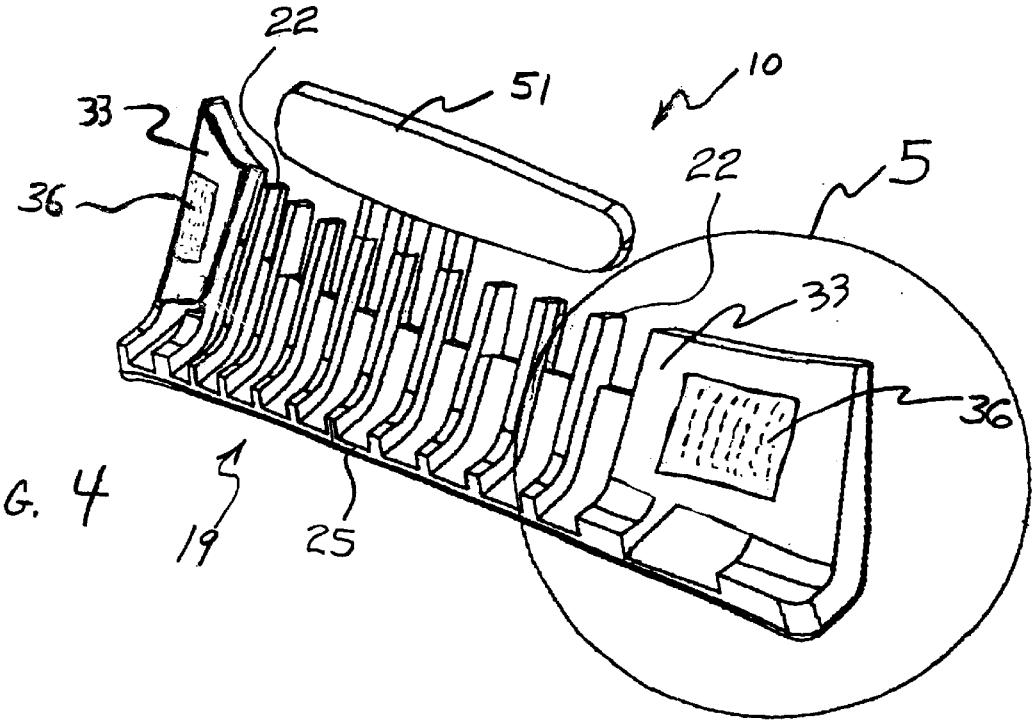
Figure 5:
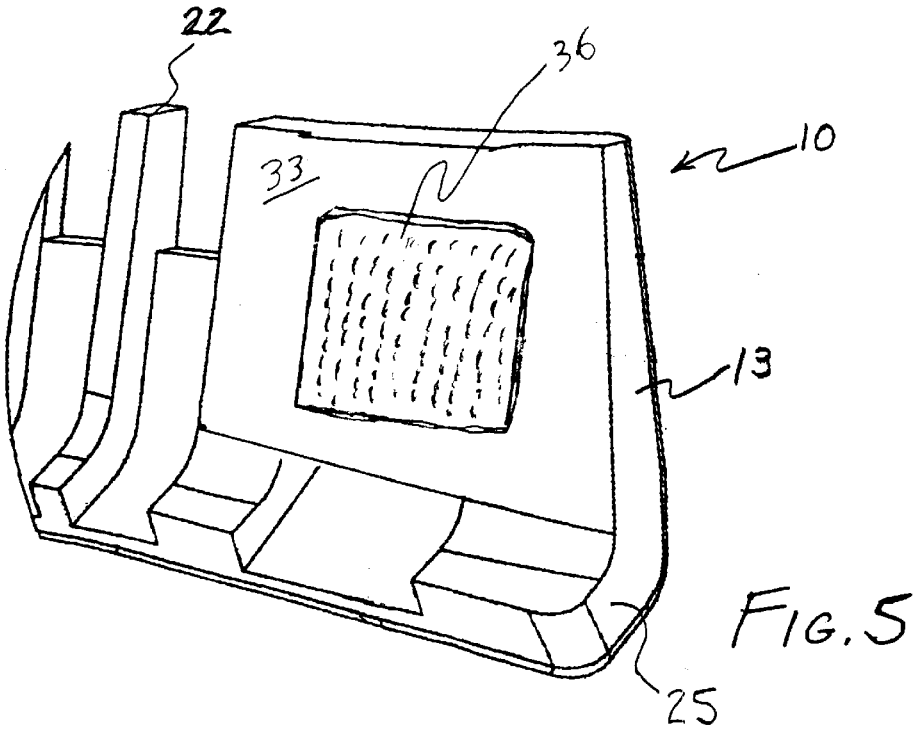
FIG. 5 is an enlarged perspective view of the area indicated as "5" in FIG. 4.

FIGS. 1–8 show a device 10 according to the invention. The device 10 includes a base 13 having an arcuate first side 16 and a second side 19. The second side 19 has a rib 22 extending from the second side 19. The base 13 preferably has a lip 25 extending away from the arcuate first side 16.

The device 10 also includes a means for selectively attaching the base 13 to a hat 30. The hat 30 may include a bill 66. The means for selectively attaching the base 13 may include an attaching surface 33 adapted to receive a primary fastener 36 for attaching the device 10 to the inside of the hat 30 such that the arcuate first side 16 faces an inside surface of the hat 30. The primary fastener 36 may be either the hook component or the loop component of a hook and loop fastener.

Figure 13:
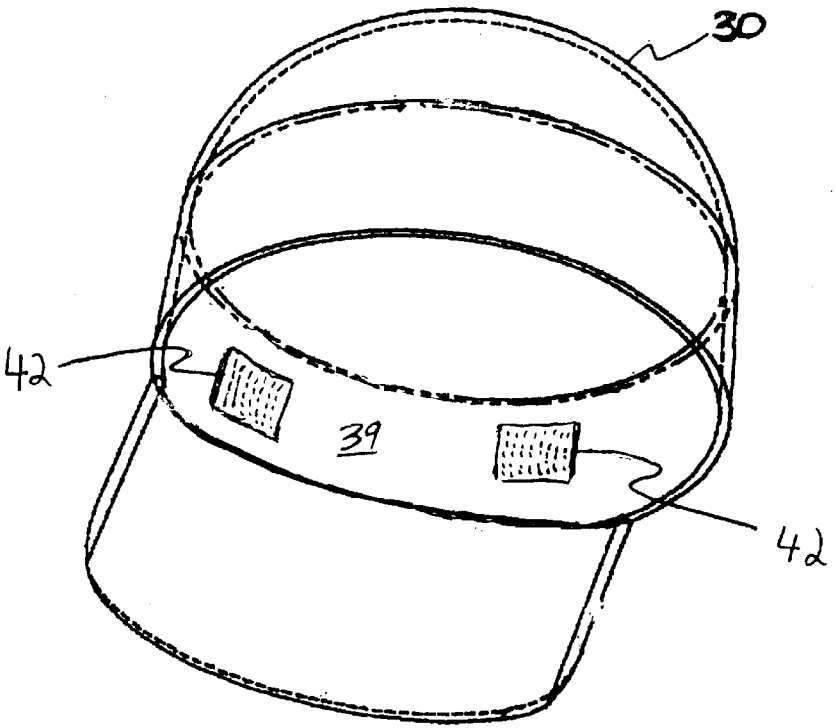
FIG. 13 is a perspective view of the hat without the device to show an example of the complementary fasteners.

FIG. 13 shows that a complementary fastener 42 may be affixed to the hat 30, for example by an adhesive or by thread stitched through both the hat and the complementary fastener 42. The complementary fastener 42 is the mating portion to the primary fastener 36. The primary fastener 36 and the complementary fastener 42 are sometimes referred to individually herein as a "mating fastener". If the primary fastener 36 is the hook component of the hook and loop fastener, then the complementary fastener 42 is the loop component of the hook and loop fastener, and if the primary fastener 36 is the loop component, then the complementary fastener 42 is the hook component.

In one such embodiment of the invention, the primary fastener 36 is attached to the attaching surface 33 by an adhesive or by thread stitched through both the attaching surface 33 and the primary fastener 36. The hooks of one of the mating fasteners engage the loops of the other mating fastener to attach the device 10 to the hat 30, and thereby affix the device 10 to the hat 30 with sufficient strength to hold the device in place while the hat 30 is worn.

Figure 6:
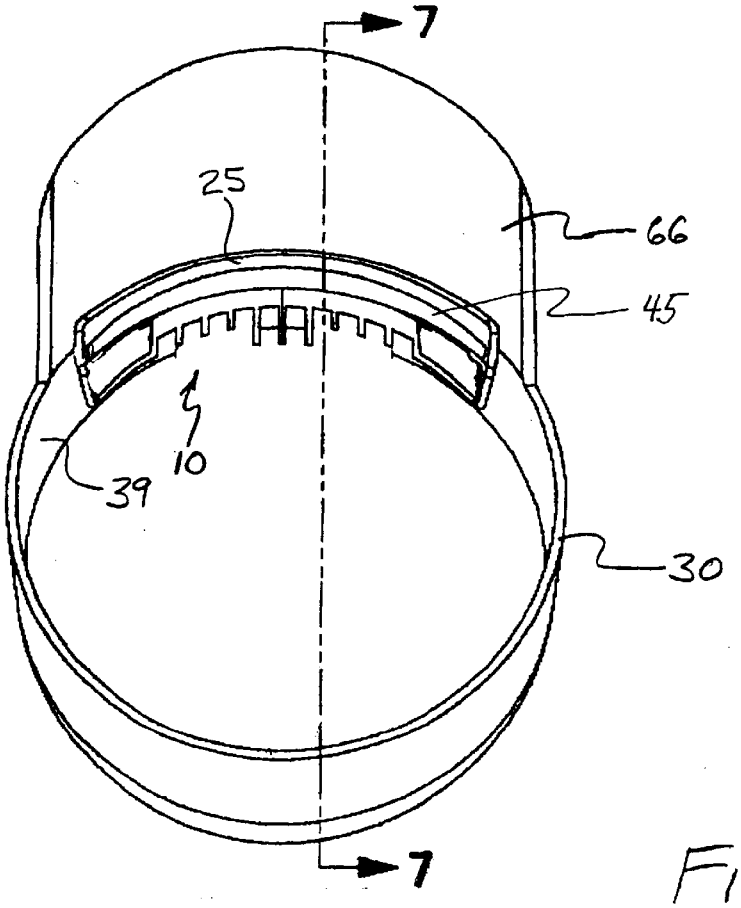
FIG. 6 is another perspective view of the hat and device shown in FIGS. 1 and 2, but unlike FIGS. 1 and 2, FIG. 6 also shows an absorbent material.
Figure 7:
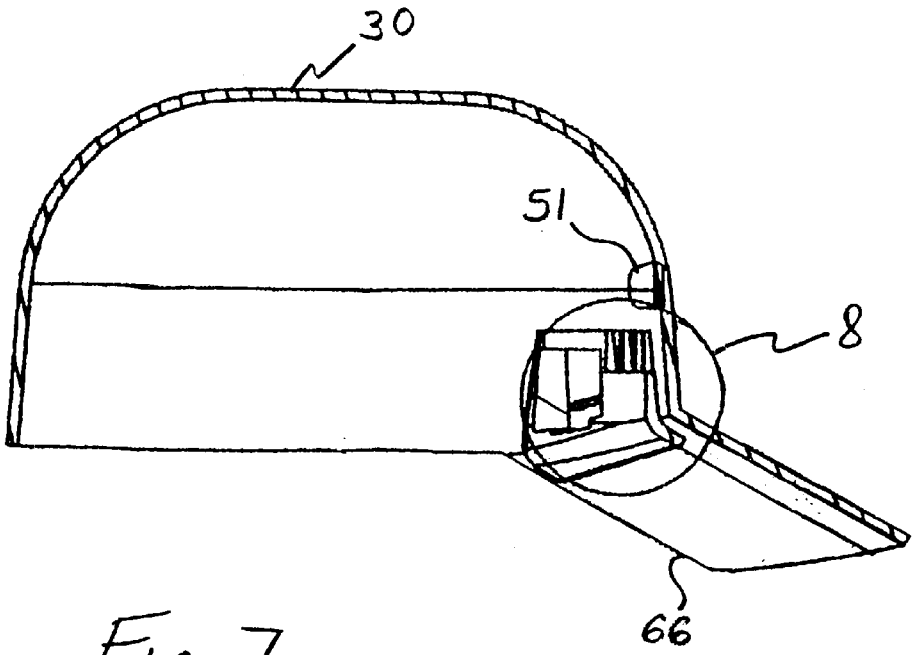
FIG. 7 is a cross sectional view of the hat and device shown in FIG. 6 taken along the line 7—7 in FIG. 6.
Figure 8:
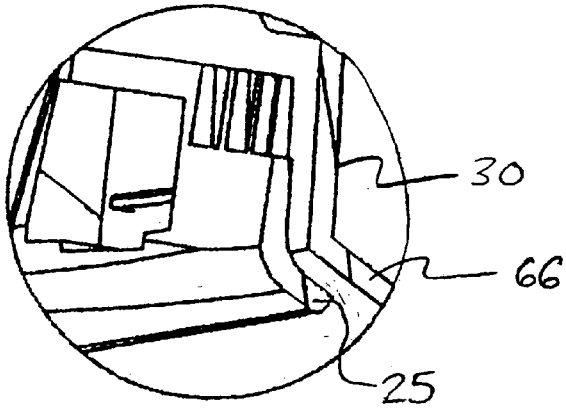
FIG. 8 is an enlarged view of the area indicated as "8" in FIG. 7.

In the embodiments described above, an absorbent material 45 may be provided on the arcuate first side 16. FIG. 6 shows such an absorbent material 45. The absorbent material 45 is intended to reside between the wearer's forehead and the arcuate first side 16 to provide a cushion for the wearer's forehead, and to absorb perspiration from the wearer. An acceptable absorbent material 45 is terry cloth.

Figure 9:
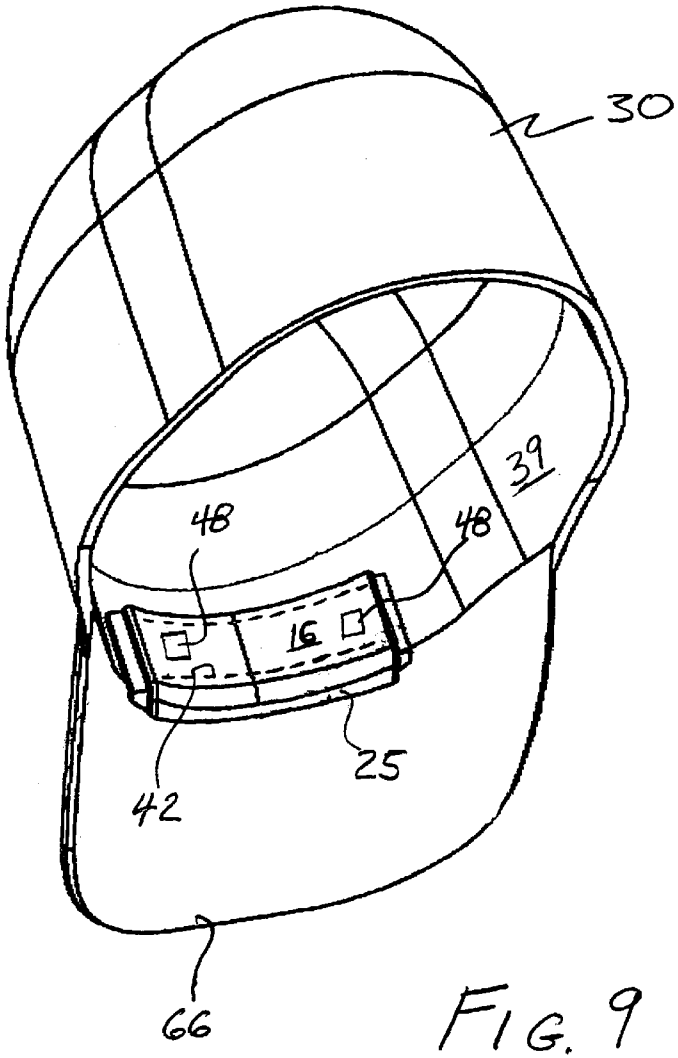
FIGS. 9 and 10 are perspective views of an alternative embodiment of the invention.
Figure 10:
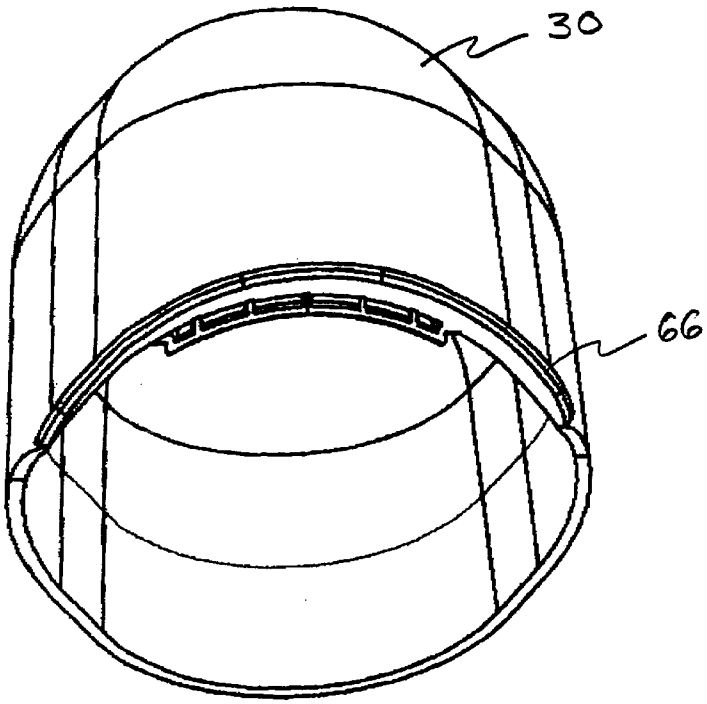
Figure 12:
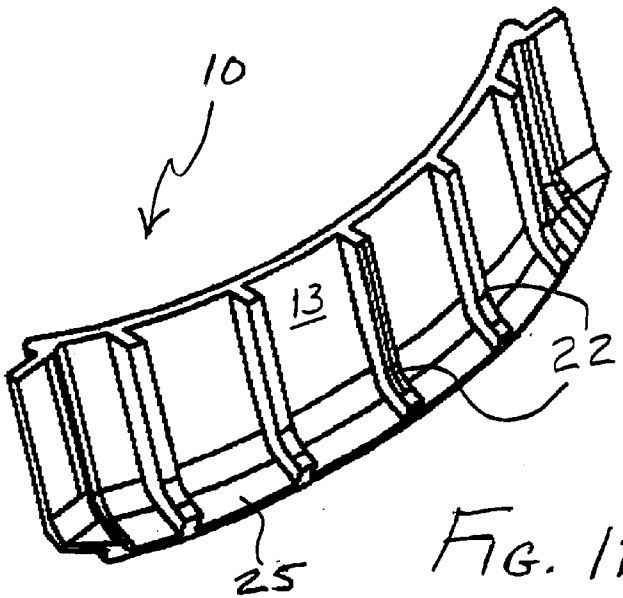
FIGS. 11 and 12 are perspective views of the device shown in FIGS. 9 and 10.
Figure 11:
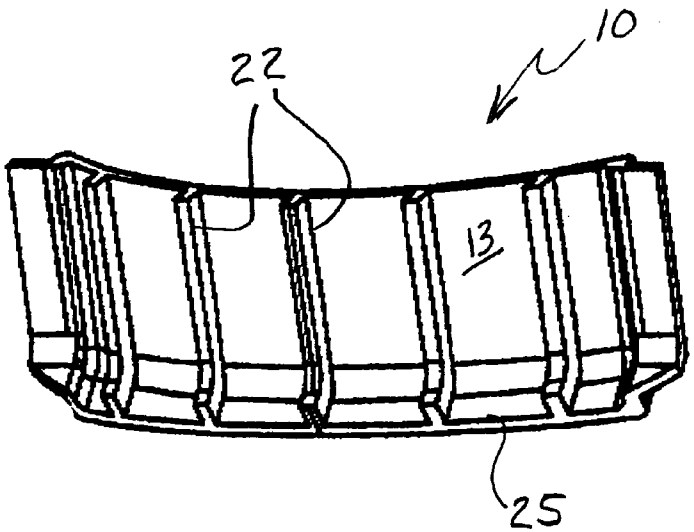

The absorbent material 45 may be selectively attached to the arcuate first side 16 by a hook and loop fastener to allow the absorbent material 45 to be removed and either cleaned or replaced with a new piece of absorbent material 45. In such an embodiment, one side of the hook and loop fastener is attached to the arcuate first side 16 and the other side of the hook and loop fastener is attached to the absorbent material 45. Alternatively, if the absorbent material 45 provides loops, as is the case in terry cloth, the hook side 48, shown in FIG. 9, of a hook and loop fastener may be attached to the arcuate first side 16 and the absorbent material 45 is attached directly to the hook side 48.

FIGS. 1, 3, 4, and 7 show an optional abutment 51 provided to help maintain the shape of the hat 30. The abutment 51 may be connected to the base 13. The abutment 51 is positioned distal from the lip 25 so as to provide a surface against which the hat 30 will rest. Preferably, the abutment 51 is arcuately shaped.

Figure 14:
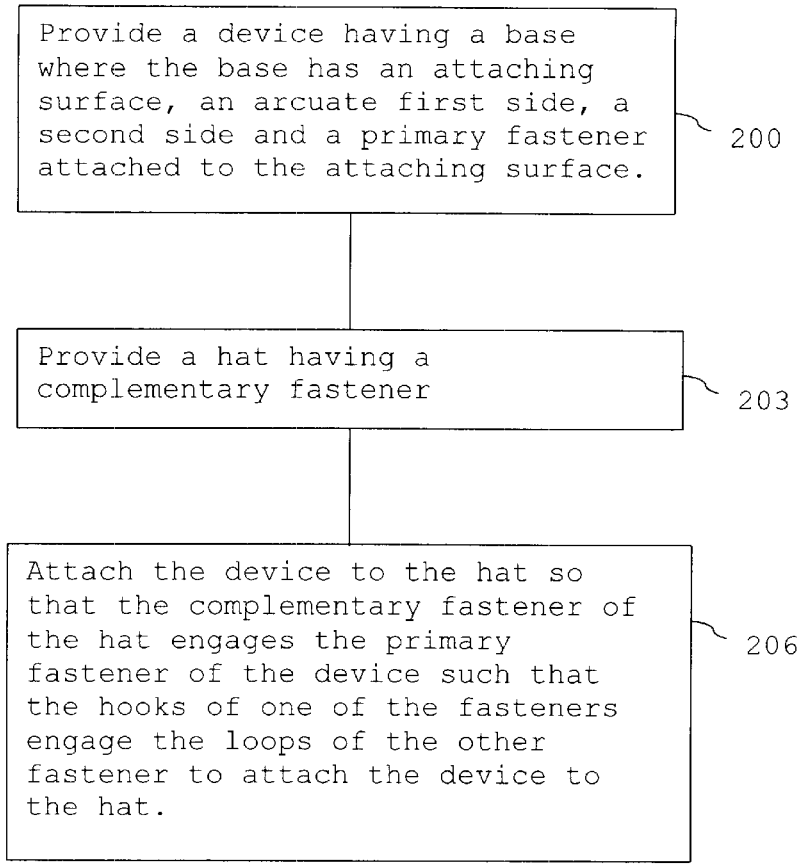
FIG. 14 is a flow chart of a method according to the invention.

The invention also includes a method of making a vented hat. FIG. 14 shows steps of a method according to the invention. The method begins by providing a device 10 having a base. The base has an attaching surface, an arcuate first side, a second side and a primary fastener 36 attached to the attaching surface (step 200). Next, a hat having a complementary fastener 42 is provided (step 203). Then, the device 10 is attached to the hat (step 206) so that the complementary fastener 42 of the hat 30 engages the primary fastener 36 of the device 10, for example so that the hooks of one of the mating fasteners engage the loops of the other mating fastener to attach the device 10 to the hat 30.

It should be noted that the invention described herein may be used in flexible hats, hard hats and helmets. Such head gear may include but is not limited to bicycle helmets, construction helmets, hockey helmets, football helmets, baseball hats and motorcycle helmets.

Although the invention has been described with respect to one or more particular embodiments, it will be understood that other embodiments of the invention may be made without departing from the spirit and scope of the invention. Hence, the invention is deemed limited only by the appended claims and the reasonable interpretation thereof.

What is claimed is:

1. An air circulation device, comprising a base having an attaching surface, an arcuate first side and a second side, the second side having ribs extending from the second side, the device further comprises a primary fastener attached to the attaching surface for fastening the device to a hat so the arcuate first side faces an inside surface of the hat, and the ribs are oriented to allow air to pass between the ribs and between a wearer's head and the hat.

2. The device of claim 1 further comprising a hat attached to the base, the hat having a complementary fastener attached to the primary fastener.

3. The device of claim 1 wherein there are multiple primary fasteners.

4. The device of claim 1 wherein there are multiple complementary fasteners.

5. The device of claim 1, wherein the base has a lip extending away from the arcuate first side.

6. The device of claim 1, further comprising an abutment connected to the base.

7. The device of claim 6, wherein the abutment is positioned distal from the lip.

8. The device of claim 6, wherein the abutment is arcuately shaped.

9. The device of claim 1 further comprising an absorbent material attached to the arcuate first side.

10. A method of providing a vented hat comprising: providing an air circulation device having a base with an attaching surface, an arcuate first side and a second side, the second side having ribs extending from the second side, the device further comprising a primary fastener for fastening the device to a hat so the arcuate first side faces an inside surface of the hat, and the ribs are oriented to allow air to pass between the ribs and between a wearer's head and the hat;

attaching the hat to the device by engaging loops of one of the fasteners with hooks of another of the fasteners.

11. The method of claim 10 wherein there are multiple fasteners on the hat and multiple fasteners on the device.

* * * * *